United States Patent [19]

Brade

[11] Patent Number: 4,776,725

[45] Date of Patent: Oct. 11, 1988

[54] EROSION CONTROL APPARATUS

[76] Inventor: Donald E. Brade, 108 John St., Kinde, Mich.

[21] Appl. No.: 103,884

[22] Filed: Oct. 2, 1987

[51] Int. Cl.[4] ..... E02B 3/06

[52] U.S. Cl. ..... 405/31; 405/29; 405/262; 405/286

[58] Field of Search ..... 405/15, 21, 25, 29, 405/30, 31, 34, 35, 262, 284, 286

[56] References Cited

U.S. PATENT DOCUMENTS

| | | | |
|---|---|---|---|
| 1,175,962 | 3/1916 | Latham | 405/31 |
| 1,993,291 | 3/1935 | Vermont | 405/286 |
| 2,069,715 | 2/1937 | Arpin | 405/25 |
| 4,129,006 | 12/1978 | Payne | 405/31 |
| 4,480,945 | 11/1984 | Schnabel | 405/262 |

*Primary Examiner*—David H. Corbin

*Attorney, Agent, or Firm*—John J. Swartz

[57] ABSTRACT

Erosion control apparatus for controlling erosion of a seashore comprising a plurality of interconnected, symmetrical lakeshore protection members. Each lakeshore protection members includes three equiangularly disposed, generally planar panels, each having one lateral edge portion integrally coupled to a hub. The lake shore protection member comprises hardened cast material having a unique reinforcing system embedded therein.

17 Claims, 2 Drawing Sheets

EROSION CONTROL APPARATUS

BACKGROUND OF THE INVENTION

1. Field of the Invention

This invention relates to erosion control apparatus for preventing erosion of a beach and more particularly to erosion control apparatus including three angularly disposed panels coupled at a central hub and adapted to be coupled in series with a plurality of identical units which are partially disposed in the water parallel to the shore line at such a depth as to dissipate the erosion effect of the wave and functions to entrap a portion of any sand entrained in the wave.

Typically, water front real estate is expensive and at a premium and thus it is important to preserve the beach front. The coastline of lakes, seas and oceans are frequently eroded when subjected to high wave action. Various attempts have been made to preserve the shoreline. One such commonly used attempt includes a vertical break wall placed along the edge of the property at the waters edge. When a wave engages such a prior art wall, the water typically separates into vertically upward and downward components. The downwardly directed water component erodes the sand along the seaside of the break wall, eventually causing the wall to become unstable and tilt toward the sea.

Accordingly, it is an object of the present invention to provide new and novel erosion control apparatus which will inhibit the erosion of soil adjacent the seaside of the apparatus.

It is another object of the present invention to provide erosion control apparatus which will upwardly dissipate a substantial portion of the wave energy.

A large portion of the prior art erosion control devices function primarily as a break wall to merely interrupt the wave's progress toward the shore . An important consideration in controlling erosion is to not only prevent the removal of the beach, but to provide apparatus which will aid the depositing of sand to the seashore. Typically, some sand is entrained in the wave water. If the wave can be directed upwardly to stop it from carrying away sand and if any sand entrained in the wave can be caught and deposited on the beach, one in fact can "build a beach". Accordingly, it is an object of the present invention to provide erosion control apparatus of the type described to accomplish that goal and which will function to control erosion and build a beach.

It is another object of the present invention to provide new and novel erosion control apparatus of the type described which will entrap sand entrained in the waves.

It is another object of the present invention to provide new and novel apparatus of the type described which will allow a portion of the wave, and sand entrained therein, to pass while inhibiting the reverse path of the sand.

It is a further object of the present invention to provide erosion control apparatus comprising a plurality of individual units which are interconnected along the seashore while being partially disposed in the water and partially disposed above the water.

It is another object of the present invention to provide erosion control apparatus of the type described including three equiangularly disposed, generally planar panels which are coupled at a central, slightly enlarged hub.

It is another object of the present invention to provide erosion control apparatus of the type described comprising hardened cast material having a unique reinforcing system embedded therein.

Some of the other apparatus provided for controlling erosion is non-symmetrical and is sometimes turned on its side in great storms and thus becomes ineffective. Accordingly, it is a further object of the present invention to provide an erosion control apparatus which is symmetrical.

It is yet another object of the present invention to provide erosion control apparatus which will maintain its effectiveness even though turned on its side.

It is a further object of the present invention to provide lake shore erosion apparatus of the type described which will be symmetrical and resist tipping and is constructed to be part of a system of connected precast segments that can be set on the beach or on the lake bottom.

It is another object of the present invention to provide erosion control apparatus of the type described including three equiangularly disposed generally planar panels joined along one edge at an integral hub.

The following United States Patents are cited as being of interest to the construction, although none of these patents, taken singularly or in combination, disclose Applicant's hereinafter claimed construction:

| | | |
|---|---|---|
| 919,788 | A. D. Smith | Apr. 27, 1909 |
| 1,175,962 | P. J. Latrham | Mar. 21, 1916 |
| 1,814,495 | D. F. Sheldon | Jul. 14, 1931 |
| 1,816,095 | H. R. Stanford | Jul. 28, 1931 |
| 2,766,592 | P. F. Danel, et al | Oct. 16, I956 |
| 3,252,287 | Suzuki | May. 24, 1966 |
| 3,368,357 | Takamori | Feb. 13, 1968 |
| 3,415,061 | A. J. Staempfli | Dec. 10, 1968 |
| 4,407,608 | Hubbard | Oct. 04, 1983 |

Other objects and advantages of the present invention will become apparent to those of ordinary skill in the art as the description thereof proceeds.

SUMMARY OF THE INVENTION

Erosion control apparatus comprising three equiangularly disposed generally planar longitudinally extending panels; a hub integrally joining one lateral edge portion of each of the panels, the panels and hub comprising cast material having reinforcing members embedded in the cast material coupling each of the panels to each of the other panels.

BRIEF DESCRIPTION OF THE DRAWINGS

The invention may be more readily understood by referring to the accompanying drawings, in which.

DESCRIPTION OF THE PREFERRED EMBODIMENT

Figure 1:
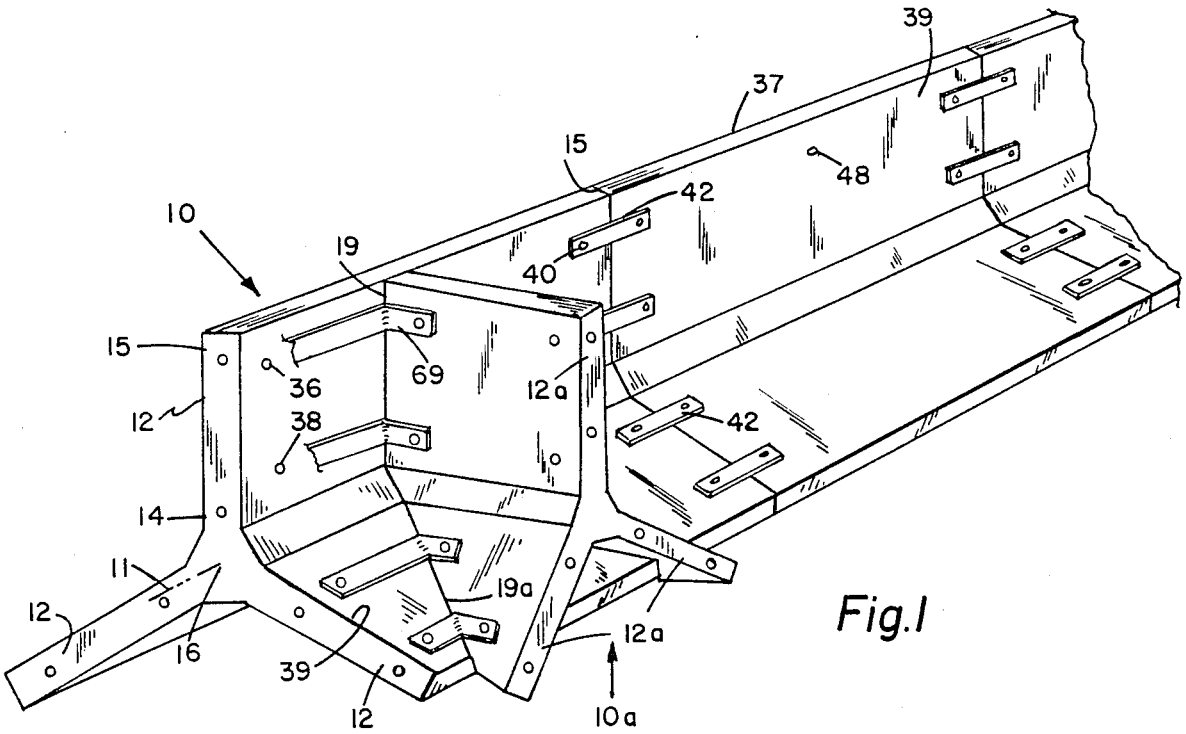
FIG. 1 is a perspective view illustrating erosion control apparatus constructed according to the present invention.

Erosion control apparatus, generally designated 10 and constructed according to the present invention, comprises a symmetrical, tri-panel jetty including three equiangularly disposed panels, generally designated 12, joined at one laterally inner edge portion 14 via an integrally formed hub 16. Each of the panels is disposed at an angle of 120° relative to the other of the panels such that the device 10 may be tipped or rolled on any of its "sides" about the longitudinal axes 11 of hub 16 and still retain its identical function.

The panels 12 and hub 16 are integrally formed of hardened cast concrete material 18 having a reinforcing steel grid, generally designated 20, embedded therein.

Figure 2:
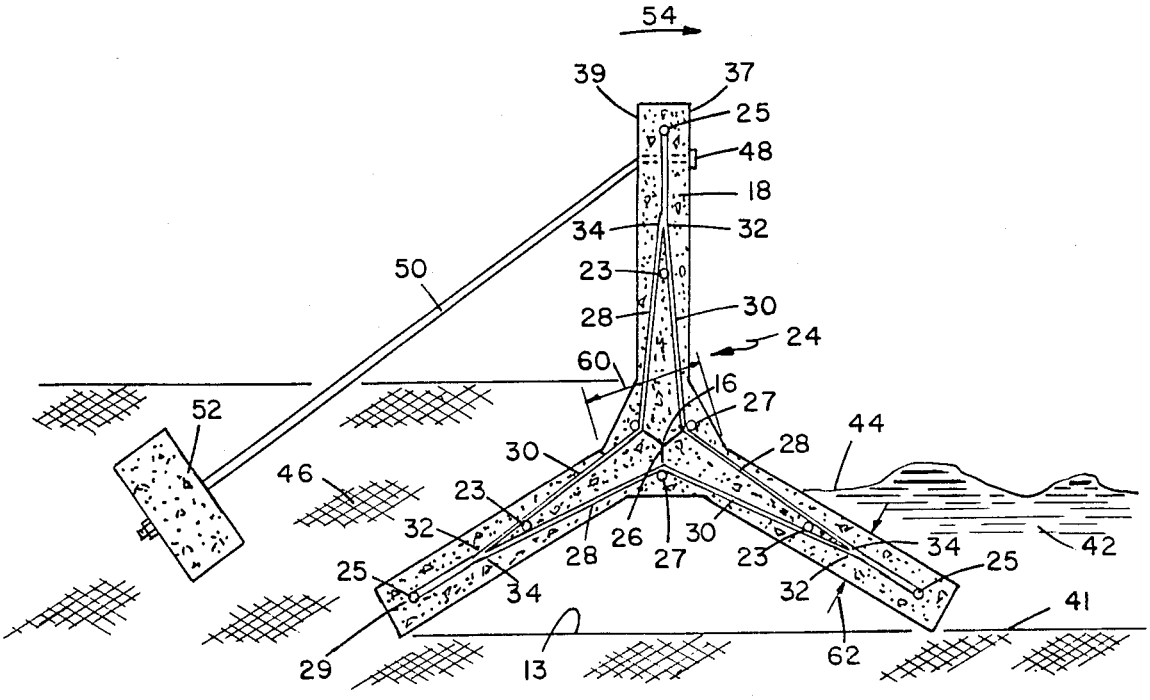
FIG. 2 is a sectional end view of the erosion control apparatus, taken along the line 2—2 of FIG. 3; slightly reduced.
Figure 3:
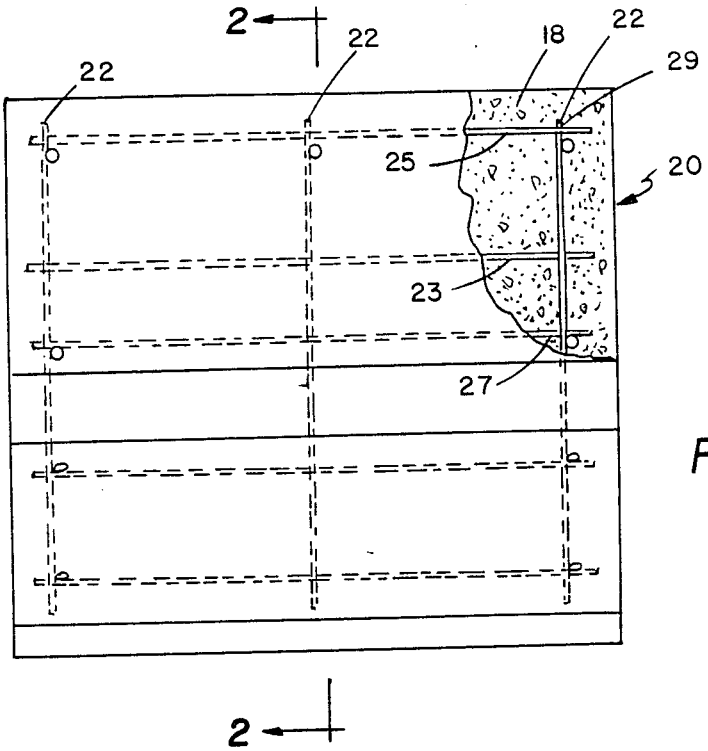
FIG. 3 is a side elevational view of the apparatus illustrated in FIG. 2.

As more particularly illustrated in FIGS. 2 and 3, the reinforcing grid 20 includes a plurality of longitudinally spaced apart reinforcing "stars" 22 coupled together via a plurality of longitudinally extending reinforcing bars 23, 25 and 27.

The reinforcing members 22 each includes a plurality of identical, v-shaped steel reinforcing bars, generlly designated 24, having an apex 26 embedded in the hub 16, a longer leg 28 including a terminal end 29, and a shorter leg 30 having a terminal end 32 which is welded or suitably fixed to a mid-portion 34 of the adjacent leg 28 in the adjacent panel intermediate the terminal end 29 and the apex 26. Each apex 26 is radially spaced from the adjacent apexes 26 in the same reinforcing member 22. The terminal ends 29 are fixed to a longitudinally extending reinforcing member 25. Each apex 26 is welded or otherwise suitably fixed to a reinforcing bar 27 and a reinforcing bar 23 is fixed to the mid-portion of the legs 26 and 28.

The abutting ends 15 of adjacent aligned panels 12 are coupled together via straps 42 fixed to bolts 40 which pass through apertures 36 and 38 that extend between the opposing parallel panel faces 37 and 39. A plurality of units 10 are thus coupled together to form an elongate wall which is disposed on the floor 41 of a lake, sea or ocean, parallel to the shore 13, such that one leg is partially disposed in the water 42 and the hub 16 is slightly above the water surface 44. If desired, the seashore side of the unit 10 may be back filled with dirt 46 to cover the opposing panel or leg 12 as illustrated in FIG. 2.

A central hole 48 is provided between the faces 37, 39 of each panel 12 for receiving a lifting tool (not shown) which is used to move the units 10 on the beach in end-to-end aligned relation. The hole 48 is also used to receive a tie rod 50 which is coupled to a bulk head 52 disposed in the dirt 46 to further inhibit swinging movement f the unit in a direction of the arrow 54 towards the water 42. The symmetrical structure has a low center of gravity and resists tipping in the direction of the arrow 54.

A standard unit 10 would include panels 12 which are 4 feet long by 4 feet wide and 8 inches thick. The hub 16 has a thickness 60 which is greater than the thickness 62 of each panel 12 to provide extra strength. The concrete 18 is typically high quality and designed to withstand pressure of 4500 pounds per square inch after 28 days of aging. The reinforcing grid 20 typically includes 96 feet of ½" reinforcing steel in each panel 12. This construction results in a unit 10 weighing over 5,000 pounds and is heavy enough to resist being tossed about by the wave 62.

To reinforce the wall and to protect erosion at the flanks, corner units, generally designated **10*a*, are provided and is constructed generally similar to that of unit 10. Generally similar parts will be referred to by identical reference characters followed by the letter a subscript. Unit 10*a* is transversely arranged, generally 90° to the end most units 10, and includes an end wall 19 which abuts the face 39 of the uppermost panel 12 which faces the shore. The end walls 19*a* of the lower two panels 12*a* are vertically inclined and abut the faces 39 of the two lower panels 12 of the endmost unit 10. Angle brackets 69 are provided as illustrated for coupling the corner unit 10*a* to the unit 10**.

ALTERNATE EMBODIMENT

Figure 4:
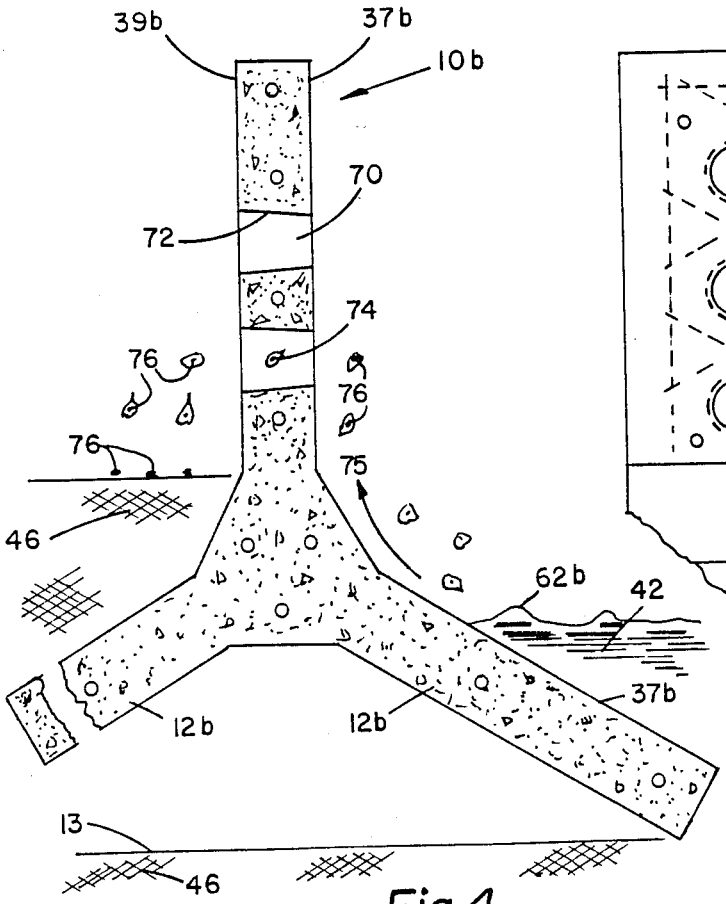
FIG. 4 is a sectional end view of a slightly modified construction, taken along the line 4—4 of FIG. 5.
Figure 5:
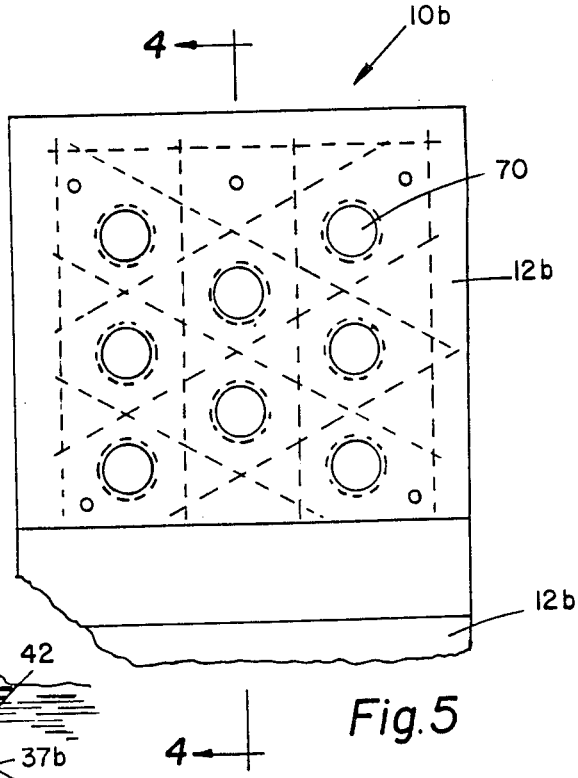
FIG. 5 is a side elevational view of the modified construction illustrated in FIG. 4.

Referring now to FIGS. 4 and 5, a slightly modified construction **10*b* is illustrated and generally similar parts will be referred to by generally similar reference characters followed by the letter b designation. The unit 10*b* differs in that the upper most panel 12*b* includes a plurality of apertures 70 passing from the face 37*b* which faces the water to the face 39*b* which faces the shore 13*b*. The apertures or holes 70 are tapered such that the side wall 72 radially outwardly diverges in a direction from the water face 37*b* to the seashore face 39*b*. As the wave water particles, represented at 74, pass through the hole 70, the hole 70 has the effect of a reverse venturi in that the velocity of the water particles 74 passing through the hole 70 would quickly reduce causing any sand 76 suspended in the water particles 74 to settle out of the water on the shoreside of the perforated units. Typically, the holes might be tapered such that the diameter of the holes adjacent to face the outer face 37*b* would be 5½" in diameter and the diameter of the holes adjacent to face 39*b*** would be 6" in diameter.

THE OPERATION

Units are placed end-to-end and coupled together via a plurality of straps 42 and bolts 40. The units are placed in the water parallel to the shoreline 13 to a depth, as that illustrated in FIG. 2, such that the center hub 16 is above the level 44 of the water 42.

Dirt 46 may be disposed on the opposite leg 12 on the shoreside of the unit 10. An end wall may be constructed by coupling a corner unit **10*a* to each of the endmost walls units 10**.

If desired, the perforated unit **10*b* may replace any or all of the units 10. The uppermost panel 12 is disposed completely above the water level 44**.

As the wave 62 approached the unit 10, it will impact the face 37 of the lower outer most panel 12 and the inclination of the panel 12 will deflect the water upwardly in a direction represented by the arrow 75 toward the uppermost panel 12. Accordingly, the wave energy will be dissipated upwardly and will prevent or inhibit erosion along the front edge of the foremost wall 12.

If the unit **10*b* is utilized, a portion of the water particles 74 will pass through the openings 70 and quickly reduce velocity and be deposited on the beach side 39*b* of the unit 10*b*. The water will eventually seep back to the sea 42. Sand 76 entrained in the water particles 74 will be deposited on the dirt 46 where it will collect with other similarly deposited sand particles 74** to aid in the building of a beach.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Erosion control apparatus for controlling beach erosion comprising a plurality of lakeshore protection members arranged end-to-end in abutting relation, generally parallel to the shoreline of a beach to be protected, and means coupling adjacent ends of adjacent ones of said lakeshore protection members together; each of said lakeshore protection members comprising:

three longitudinally extending symmetrical panels each having a laterally inner edge portion integrally joined at a central hub, an outer terminal edge portion, and a pair of symmetrical faces extending between said inner and outer edge portions of each panel;

said panels comprising hardened cast material and reinforcing means embedded in said cast material;

said reinforcing means comprising a plurality of longitudinally spaced apart members extending from each of said panels into each of the two adjacent panels, and at least one longitudinally extending member embedded in each of said panels coupled to said longitudinally spaced apart members.

2. The apparatus set forth in claim 1 wherein each of said longitudinally spaced apart members comprises a generally v-shaped rod having a central portion embedded in said hub and spaced from the central portions of the adjacent v-shaped rods.

3. The apparatus as set forth in claim 2 wherein said v-shaped rods each include outwardly diverging leg portions coupled to the adjacent outwardly diverging leg portion of the adjacent v-shaped rod.

4. The apparatsu as set forth in claim 3 including additional longitudinally extending reinforcing members coupled to the central portion of said v-shaped rod and embedded in said hub.

5. The apparatus set forth in claim 4 wherein said symmetrical faces of each of said panels are parallel; at least one of said panels including a transverse passage extending therethrough from one face to another to allow water, and any sand entrained in the water, to pass therethrough.

6. The apparatus set forth in claim 5 wherein said panels are equiangularly disposed about a central axis; and said passage has a sidewall which outwardly diverges in a direction from one face toward the other face of each panel.

7. The apparatus set forth in claim 5 wherein said channel includes a sidewall which converges between said one face and said another face.

8. The apparatus set forth in claim 7 wherein said means coupling adjacent ends of adjacent ones of said lake shore protection members together comprises a plurality of holes cast in the end portion of each panel and coupling members received in the adjacent holes of adjacent ends of said adjacent panels.

9. The apparatus set forth in claim 8 including a further hole cast in said panel between said end portions and extending between said opposing faces to receive a tie-back rod for tying the apparatus to the shore.

10. The erosion control apparatus set forth in claim 1 including an additional lake shore protection end member arranged transversely to and abutting an end most one of said aforementioned lake shore protection member, said additional lakeshore protection member including;

three equiangularly disposed panels coupled at a central hub;

one of said panels of said end member being upright and having a generally vertical end wall abutting a side face of one of the panels of the endmost lake shore protection member, the other two of said panels of said end member including vertically inclined end walls abutting a side face of one of the other two panels of said lakeshore protection member.

11. Erosion control apparatus for controlling lakeshore beach erosion by lake water comprising:

three longitudinally extending equiangularly disposed panels each joined along one lateral edge at a central hub;

said panels comprising hardened cast material;

a plurality of longitudinally spaced apart reinforcing means embedded in said hardened cast material of each panel extending through said hub and into each of the other two panels;

at least one longitudinally extending member embedded in said cast material to said longitudinally spaced apart members;

one of said panels including one face adapted to be disposed toward the beach and a generally parallel opposite face adapted to be disposed toward the lake water; and a passage, having an axis, extending between said faces having a sidewall diverging radially outwardly, relative to its axis, in a direction from said opposite face to said one face.

12. Erosion control apparatus for controlling erosion of a seashore by sea water waves comprising:

three generally planar, equilangularly disposed longitudinally extending panels of a predetermined thickness;

hub means, having a greater predetermined thickness, integrally joined to one lateral edge portion of each of said panels;

said panels and said hub means comprising cast material and reinforcing means embedded in said panels and said hub means comprising a plurality of longitudinally spaced apart reinforcing members extending from each of said panels through said hub means into each of the other panels; and a plurality of longitudinally extending reinforcing rods coupling said longitudinally spaced apart reinforcing members;

one of said panels being upstanding and including generally parallel first and second faces adapted to face the sea water and seashore, respectively, and water dampening passage means extending through said one panel and including a cylindrical sidewall flaring outwardly in a direction from said first face to said second face.

13. The erosion control apparatus set forth in claim 12 wherein one of said panels includes aperture means therein and coupling means is receiving in said aperture means for coupling said apparatus to an identical erosion control apparatus.

14. The erosion control apparatus set forth in claim 13 wherein said erosion control apparatus includes tie-back aperture means therein, and a tie-back rod received therein and extending in a direction from said one face to said second face toward said seashore.

15. The erosion control apparatus set forth in claim 12 wherein said reinforcing members comprise a generally v-shaped rod having an apex embedded in said hub means and spaced from the apexes of the adjacent v-shaped rods and outwardly diverging legs embedded in adjacent panels and fixed to the legs of adjacent v-shaped rods.

16. The erosion control apparatus set forth in claim 15 wherein one of said legs of each v-shaped rod is shorter than the other of said v-shaped rods;

the terminal end of each of said one leg being fixed to the other of said legs of said adjacent v-shaped rod between said apex and the terminal end of the other of said legs.

17. Erosion control apparatus for controlling beach erosion comprising:

a plurality of lakeshore protection members, arranged end-to-end in abutting relation, generally parallel to the shoreline of a beach to be protected; and means coupling adjacent ends of adjacent ones of said lakeshore protection members together;

each of said lakeshore protection members comprising:

three longitudinally extending symmetrical panels each having a laterally inner edge portion integrally joined at a central hub, an outer terminal edge portion, and a pair of symmetrical faces extending between said edge portions;

said panels comprising hardened cast material and reinforcing means embedded in said cast material;

said reinforcing means comprising:

a plurality of longitudinally spaced apart members extending from each of said panels into each of the two adjacent panels, and at least one longitudinally extending member embedded in each of said panels coupled to said longitudinally spaced apart members;

an additional lake shore protection end member arranged transversely to and abutting an endmost one of said aforementioned lake shore protection member, said additional lakeshore protection member including;

three equiangularly disposed panels coupled at a central hub;

one of said panesl of said end member being upright and having a generally vertical endwall abutting a side face of one of the panels of the endmost lake shore protection member, the other two of said panels of said end member including vertically inclined endwalls abutting a side face of one of the other two panels of said lakeshore protection member.

* * * * *